US005407194A

United States Patent [19]

Snow

[11] Patent Number: 5,407,194

[45] Date of Patent: Apr. 18, 1995

[54] GOLF RANGE BALL POSITIONER

[76] Inventor: Richard Snow, 3511 N. 55th Ave., Hollywood, Fla. 33021

[21] Appl. No.: 254,699

[22] Filed: Jun. 6, 1994

Related U.S. Application Data

[63] Continuation-in-part of Ser. No. 189,655, Feb. 1, 1994, abandoned.

[51] Int. Cl.[6] ..... A63B 57/00

[52] U.S. Cl. ..... 273/32 B; 273/32.5; 294/19.1

[58] Field of Search ..... 273/32.5, 32 B, 201, 273/162 E, 32 F; 294/19.1, 19.2

[56] References Cited

U.S. PATENT DOCUMENTS

| | | | |
|---|---|---|---|
| 2,609,198 | 9/1952 | Armstrong | 273/32.5 |
| 4,313,604 | 2/1982 | Baxter | 273/32 A |
| 4,951,947 | 8/1990 | Kopfle | 273/32.5 |
| 5,171,010 | 12/1992 | Lanoue | 273/32.5 |

*Primary Examiner*—George J. Marlo
*Attorney, Agent, or Firm*—Oltman and Flynn

[57] ABSTRACT

An apparatus for scooping up and depositing a golf ball on a permanent golf range tee includes a ball retaining platform member having an upper surface and a lower surface, and having an edge including a ball-retaining notch for receiving and retaining a golf ball, a tee locating member joined to the platform member by a hinge or sliding posts for permitting the tee locating member and the platform member to move toward each other and away from each other to a predetermined extent while remaining structurally connected, so that the tee locating member may be slidably spaced below the lower surface, the tee locating member having an edge with a tee-receiving notch, and an elongate handle member having a first end and a second end and secured to the platform member at the first end. A method of positioning a golf ball onto an upright golf range tee, using the above-described apparatus, includes the steps of gripping a second end of the handle member and placing the platform member near a golf ball, maneuvering the ball onto the platform member upper surface and into the notch, lifting the apparatus and ball with the handle member, fitting the tee locating member notch around and against the shank portion of a mounted golf range tee, thereby automatically positioning the ball directly over the tee, and lowering the handle and platform members until the ball rests on the tee, and then maneuvering the platform member out from under the ball, leaving the ball mounted on the tee.

12 Claims, 4 Drawing Sheets

GOLF RANGE BALL POSITIONER

This application is a continuation-in-part of application Ser. No. 08/189,655, filed on Feb. 1, 1994, and now abandoned.

BACKGROUND OF THE INVENTION

1. Field of the Invention

The present invention relates generally to the field of devices for assisting a golf player in handling a golf ball, and more specifically to an apparatus for scooping up and depositing a golf ball on a permanent golf range tee including a ball retaining platform member having an upper surface and a lower surface, the upper surface having an edge including a rounded ball-retaining notch for receiving and retaining a golf ball, a tee-locating member which is preferably joined with hinge or sliding spacing means to the platform member to pivot or slide flat against the lower surface and downward relative to the platform member, the tee-locating member having an edge with a tapering tee-receiving notch just below the ball retaining notch, the platform member being secured to a first end of an elongate handle member substantially perpendicular to the elongate handle member longitudinal axis, and to a method wherein the player grips a second end of the handle member and places the platform member near a golf ball to be played, and maneuvers a ball onto the platform member upper surface and into the rounded notch such as by scooping the ball or pushing the ball with his foot, and then lifts the handle member and thus the platform member and ball, while the tee-receiving member moves down relative to the platform member lower surface by its own weight, the player then fits the tee-receiving member notch around and against the shank portion of an upright golf range tee, thereby automatically positioning the ball directly over the top of the tee, then the player lowers the handle and platform member until the ball rests on the tee, and then maneuvers the platform member out from under the ball, leaving the ball mounted on the tee.

2. Description of the Prior Art

There have long been devices for inserting and removing golf tees from golf course turf and for placing golf balls onto golf tees. These devices have generally been cumbersome, complex and costly and not specially designed for permanent golf range tees. For purposes of this application, the top or head of a golf tee on which the ball rests will be termed the nest portion and the remainder of the tee will be termed the shank portion.

One prior device is that of Miotke, U.S. Pat. No. 3,206,197, issued on Sep. 14, 1965. Miotke teaches a golf ball tee handling tool including an elongate tubular handle. The handle has a tee engaging fork element extending transversely and spaced apart from one handle end. A tee is placed between the tines of the fork element and positioned to be substantially coaxial with the handle, with the pointed tee end extending out from the tool. A spring-loaded abutment member extends axially from within the tubular handle and against the nest portion of the tee to hold the tee in the fork. Then the handle is manipulated to orient and insert the tee into the golf course turf, without the player stooping. A problem with Miotke is that the tool has no provision for placing a golf ball onto the tee without stooping. Another problem with Miotke is that a permanent tee may already be provided on a mat at a golf course, and the device is not designed to securely hold a ball without a tee being held with the ball.

Baxter, U.S. Pat. No. 4,313,604, issued on Feb. 2, 1982, discloses a golf tee and ball stick device. Baxter has an elongate handle with a multiple-function assembly at its distal end. The assembly includes opposing leaf spring elements for resiliently gripping a tee. The pointed end of the tee extends axially outward below the handle. It also includes an adjustable tee abutment bolt to bear against the nest portion of the tee and determine the tee insertion depth. A platform with a dish-shaped upper face retains a ball, and a slot through the platform permits the platform to descend around the tee while a ball on the platform is deposited on the nest portion of the tee. A platform notch is provided for engaging the tee shank portion and extracting the tee, and tee-carrying rack elements are provided on a platform edge. A problem with Baxter is that the device is complicated and relatively expensive to manufacture. Another problem is that no provision apart from trial and error is made for centering the ball over the tee when placing the ball on the nest portion. Another problem with Baxter is that a permanent tee may already be provided on a mat at a golf course, and the device is not designed to securely hold a ball without a tee being held with the ball. Baxter is also designed to be used for tee insertion, not with a permanent tee.

Phelps, U.S. Pat. No. 4,526,369, issued on Jul. 2, 1985, reveals a golf aid device for setting a ball on a tee, including an elongate handle with a ball engaging assembly at one end. The assembly includes a bell-shaped housing flared from a handle end. A hollow support leg extends from a housing edge and a forked jaw portion pivots from the support leg below the housing. A cable extends from the jaw portion up through the support leg and handle to a control member. A tee is placed in the fork of the jaw portion with the point extending outward and coaxially with the handle. A golf ball is placed on the nest portion of the tee and the jaw portion is closed to push the ball into engaging contact with the flared housing edge. Then the tee is forced into the golf turf and the mounted ball and tee are released together. A problem with Phelps is that a permanent tee may already be provided on a mat at a golf range, and the device is not designed to securely hold a ball without a tee being held with the ball. Another problem is that no provision short of hit and miss is provided for centering the ball over a tee already in place. Phelps is also designed to be used for tee insertion, not with a permanent tee.

Hill, U.S. Pat. No. 4,819,938, issued on Apr. 11, 1989, teaches a golf ball and tee placement and retrieval tool generally similar to that of Phelps. Hill includes an elongate handle with a ball and tee engaging assembly at its working end. The assembly includes a pair of jaw portions which are opened and closed from a lever on the gripping end of the handle. The lever controls the jaw portions through a cable and linkages. The jaw portions have widely spaced bowed sections which close around opposing sides of a golf ball and closer together tip sections which engage the shank portion of a tee. The ball is held against the nest portion of the tee and the tee is inserted into the ground. The problems of Phelps are again presented.

Kopfle, U.S. Pat. No. 4,951,947, issued on Aug. 28, 1990, discloses a golf ball teeing device. A cylindrical housing at an end of an elongate handle has an open side for receiving and retaining a golf ball. A tee is placed in a slot in the remote housing wall, a lever-operated clamp assembly pushes the ball in the housing against the nest portion of the tee. The tee pointed end is then inserted into the golf course turf. A pointed sliding latch structure is provided on the housing for pressing a tee-receiving hole into frozen turf. A problem with Kopfle is once again that no provision is made for centering the ball over a permanent golf range tee.

Tobias, U.S. Pat. No. 4,969,646, issued on Nov. 13, 1990, reveals a golf ball and tee placement device. A ball engaging plunger member extends through tubular handle to bear against a ball retained on a tee in a forked arm at the end of the handle. The point of the tee extends outward from the end of the device, and is inserted into the turf. Then the plunger member is axially withdrawn from contact with the ball to release the mounted ball and tee. Once again, the problems of Kopfle are presented.

Wolf, U.S. Pat. No. 5,080,357, issued on Jan. 14, 1992, discloses a golf ball and tee setting device. A ball mounted on a tee nest portion is placed and retained between two opposing cup portions of a jaw assembly similar to that of Wolf, and the tee shank portion is held in a slot adjacent to the cup portions. A spring-loaded, linkage controlled ball and tee engagement lever assembly is contained within a handle portion. A problem with Wolf is that it is complex and would be expensive to manufacture. Wolf also makes no provision for centering and placing a ball on an already positioned and secured permanent range tee.

It is thus an object of the present invention to provide an apparatus and method for a player to scoop up and place a golf ball on the nest portion of a golf range tee, without stooping.

It is another object of the present invention to provide such an apparatus and method which automatically align the ball over the tee nest portion.

It is still another object of the present invention to provide such an apparatus and method which securely engage the tee shank portion without sliding against and tilting the tee while the ball is lowered into the tee nest portion.

It is finally an object of the present invention to provide such an apparatus and method which are simple, reliable and inexpensive to manufacture.

SUMMARY OF THE INVENTION

The present invention accomplishes the above-stated objectives, as well as others, as may be determined by a fair reading and interpretation of the entire specification.

An apparatus is provided for placing a golf ball on a golf range tee, including a ball retaining platform member having an upper surface and a lower surface, and having an edge including a ball-retaining notch for receiving and retaining a golf ball, a tee locating member hingedly joined to the platform member and spaced below the lower surface, the tee locating member having an edge with a tee-receiving notch, and an elongate handle member having a first end and a second end and secured to the platform member at the first end. The tee locating member is preferably hingedly joined to the platform member to pivot upward to a first position flat against the lower surface and downward to a second position to an acute angle relative to the lower surface. The ball retaining notch is preferably rounded to substantially match the curvature of the golf ball. The tee receiving notch is preferably wider at its open end and tapers inwardly. The platform portion is preferably substantially perpendicular to the elongate handle member. The ball receiving notch preferably has an upper edge which is beveled to seat the golf ball. The elongate handle member preferably additionally includes a perpendicular segment secured at the second end for enhancing manual control of the apparatus.

An apparatus is also provided for placing a golf ball on a golf range tee which includes a ball retaining platform member having an upper surface and a lower surface, and having an edge including a ball-retaining notch for receiving and retaining a golf ball, a tee locating member joined to the platform member by sliding posts for permitting the tee locating member and the platform member to move toward each other and away from each other to a predetermined extent while remaining structurally connected, so that the tee locating member may be slidably spaced below the lower surface, the tee locating member having an edge with a tee-receiving notch, and an elongate handle member having a first end and a second end and secured to the platform member at the first end. Once again, the ball receiving notch preferably includes an upper edge which is beveled to seat the golf ball and the elongate handle member preferably includes a perpendicular segment.

A method is provided of positioning a golf ball onto an upright golf range tee, using the above-described apparatus, including the steps of gripping a second end of the handle member and placing the platform member near a golf ball, maneuvering the ball onto the platform member upper surface and into the notch, lifting the apparatus and ball with the handle member, fitting the tee locating member notch around and against the shank portion of a mounted golf range tee, thereby automatically positioning the ball directly over the tee, and lowering the handle and platform members until the ball rests on the tee, and then maneuvering the platform member out from under the ball, leaving the ball mounted on the tee.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
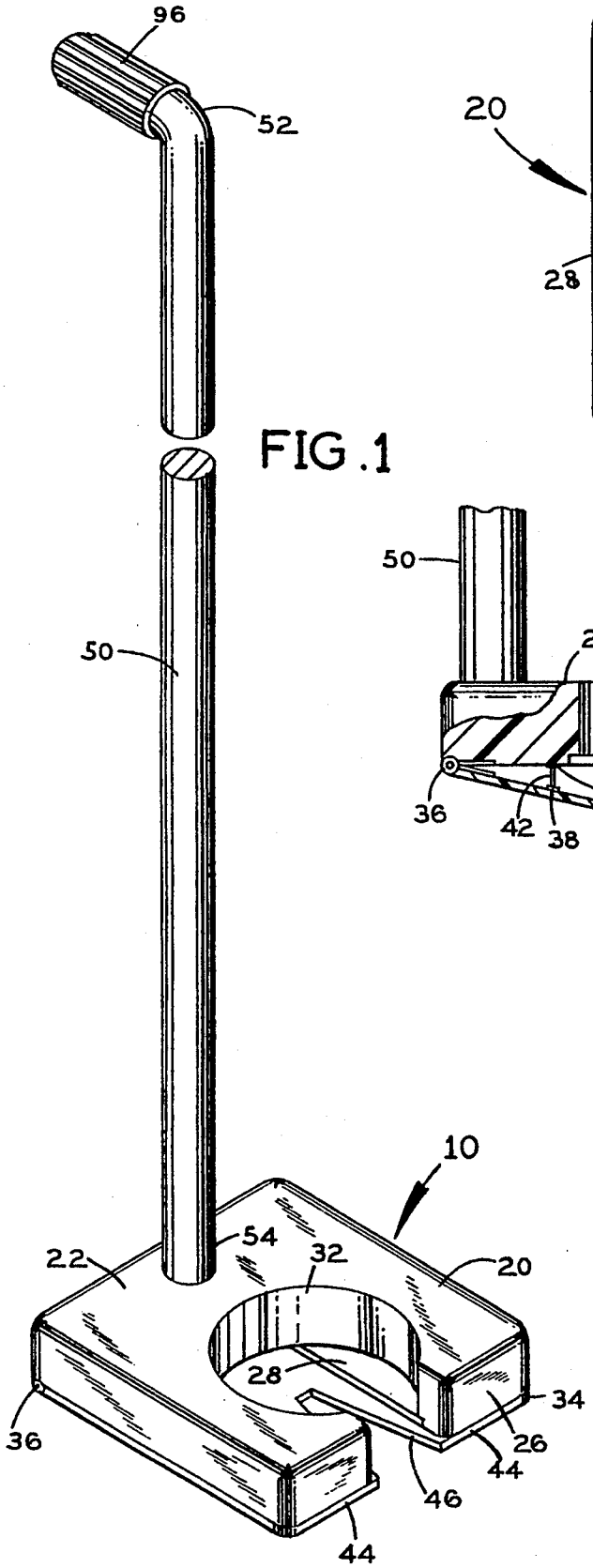
FIG. 1 is a perspective view of the inventive ball positioning apparatus with the tee-locating member pivoted into a closed position against the lower surface of the platform member.
Figure 2:
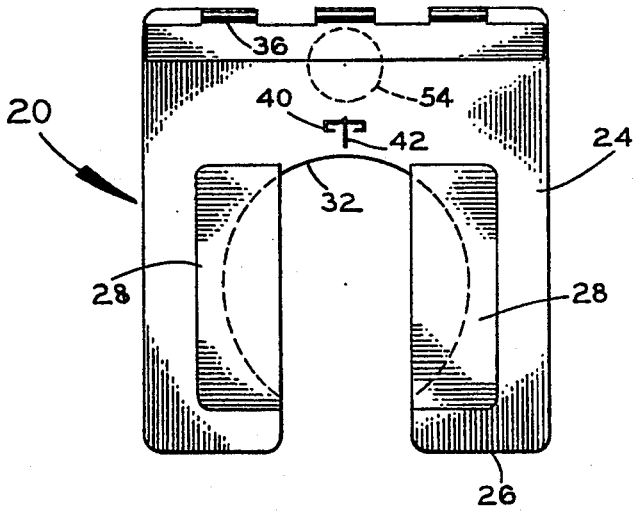
FIG. 2 is a bottom view of the platform member showing the preferred shape of the ball retaining notch and location of ball retaining plates, partially covering opposing notch edges.
Figure 3:
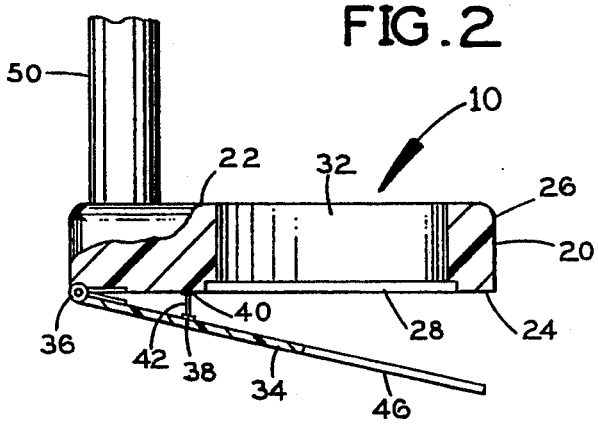
FIG. 3 is a side view of the platform member and tee locating member suspended therefrom at an acute angle with a hinge element and a stop filament.
Figure 4:
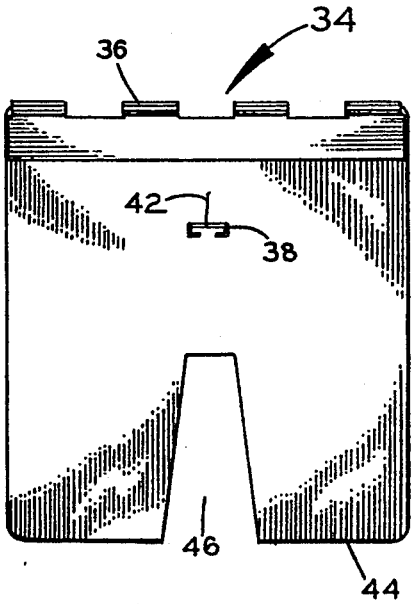
FIG. 4 is a top view of the inventive tee-locating member, showing the filament fastener and preferred tee-receiving notch shape.
Figure 5:
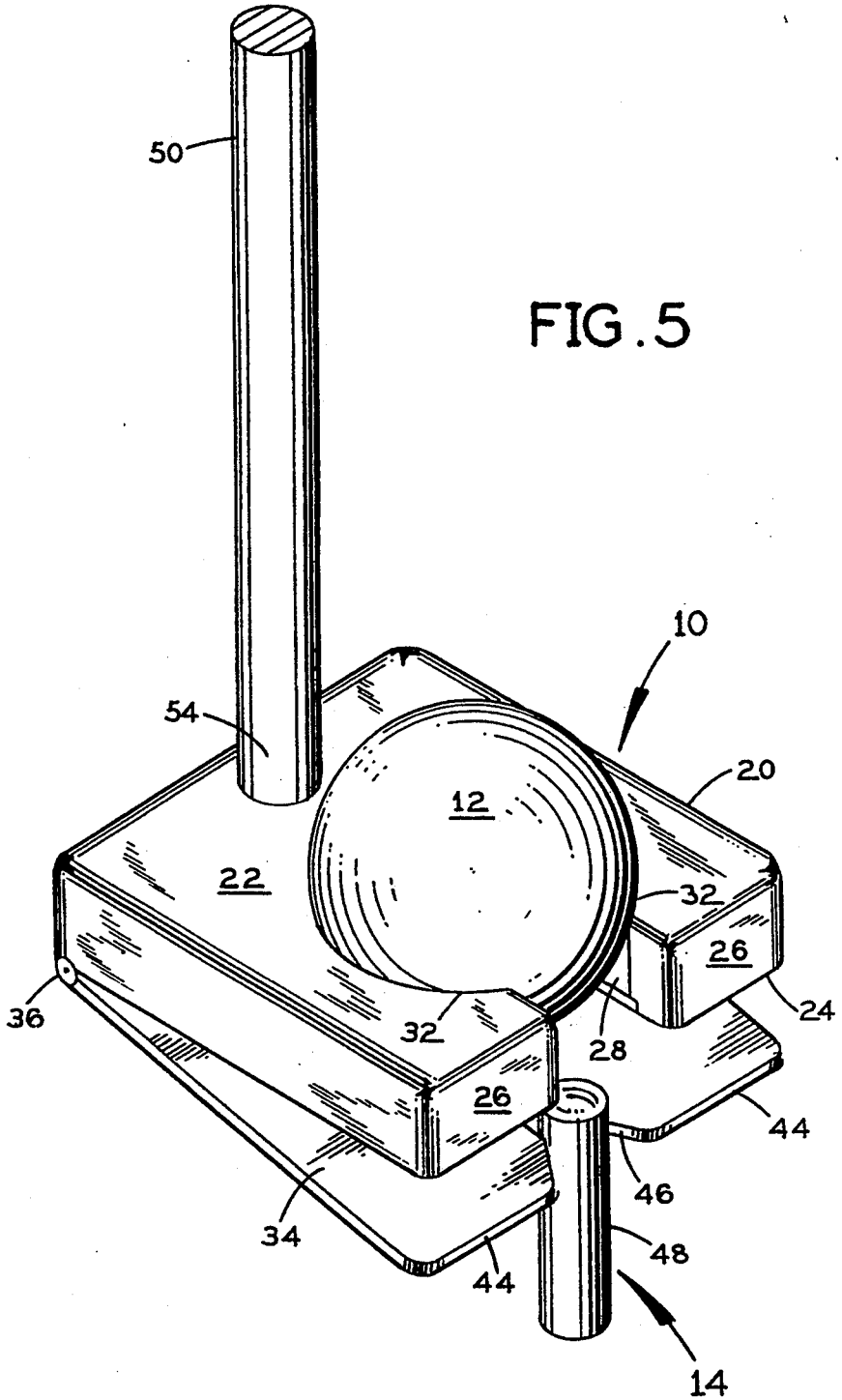
FIG. 5 is a broken-away perspective view of the platform member retaining a golf ball and the tee locating member engaging a tee and positioning the ball directly over the tee nest portion.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIGS. 1–5, a golf ball mounting apparatus 10 is disclosed for scooping up and placing a golf ball 12 on a golf range tee 14. Apparatus 10 preferably includes a ball-retaining platform member 20 having an upper surface 22 and a lower surface 24. Upper surface 22 has an edge 26 including a rounded ball-retaining notch 32 for receiving and retaining a golf ball 12. Where notch 32 is wide enough for a ball 12 to drop through it, parallel retaining plates 28 are provided on opposing sides of notch 32. See FIG. 2. A tee locating member 34 is joined to platform member 20, preferably with a hinge element 36. Member 34 is retained against full pivoting by a stop filament 42. See FIG. 3. Filament 42 is anchored to lower surface 24 with fastener 40 and fastened to tee locating member 34 with fastener 38. See FIG. 4. Tee locating member 34 pivots between a closed position flat against lower surface 24 and an open position downward to an acute angle relative to the lower surface 24. Tee locating member 34 has an edge 44 with a tapering tee-receiving notch 46, just below ball-retaining notch 32. Platform member 20 is secured at a first end 54 of an elongate handle member 50 which is substantially perpendicular to platform member upper surface 22.

The pivoting of tee locating member 34 serves several purposes. First, notch 46 can remain fixed against tee shank portion 48 while notch 32 moves relative to tee 14. Second, the hinging apart of notches 32 and 46 provides a separation for more accurate ball 12 and tee 14 alignment. Third, the hinging together of members 20 and 34 when apparatus 10 is not in use makes storage more compact. Apparatus 10 fits easily into a golf bag together without obstructing the clubs. Also, apparatus 10 is free-standing, resting on tee locating member 34 with handle member 50 extending vertically upward for convenient player access. Tee-locating member 34 may alternatively be fixedly secured below lower surface 24 and rigidly connected to platform member 20.

Second Preferred Embodiment

Figure 6:
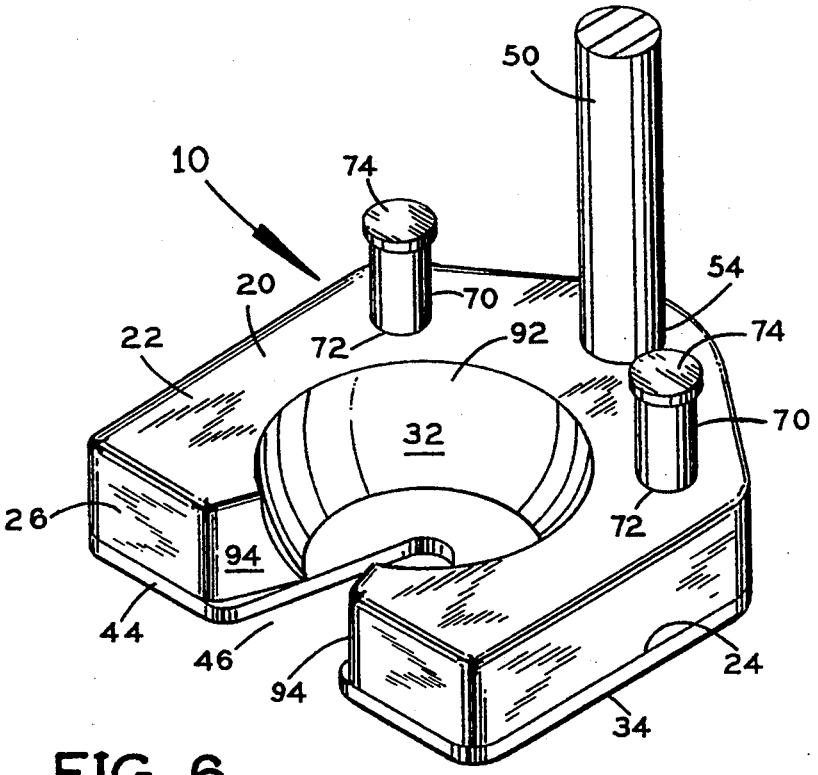
FIG. 6 is a perspective view of the second preferred embodiment of the inventive ball positioning apparatus, where the tee locating member is slid up against the lower surface of the platform member in the storage position.
Figure 7:
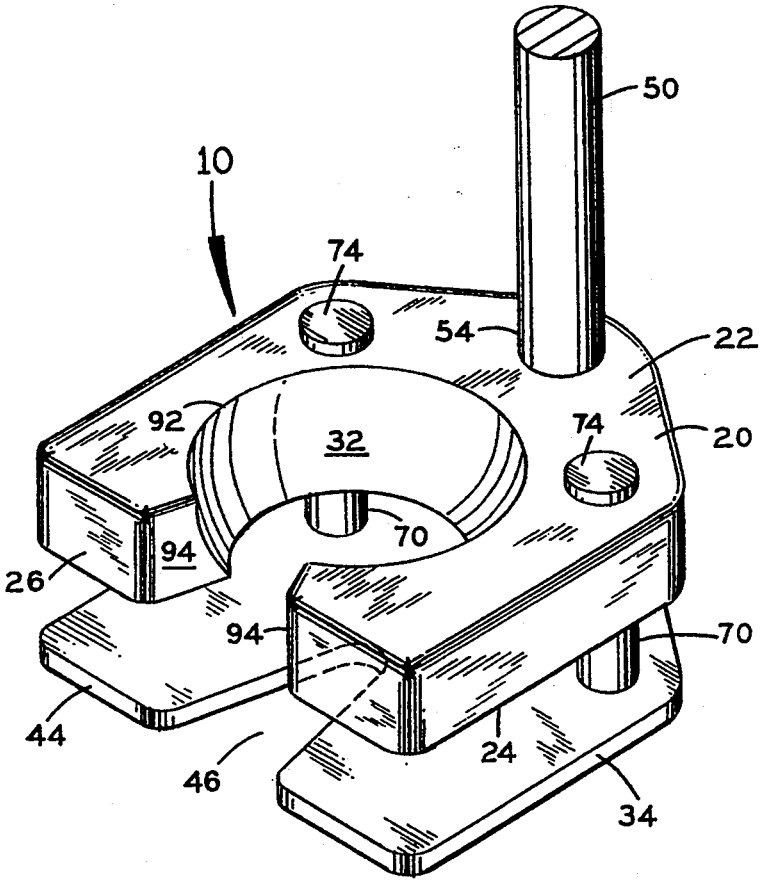
FIG. 7 is a view as in FIG. 6, except that the tee locating member is slid to an extended, spaced apart position below the platform member lower surface.
Figure 8:
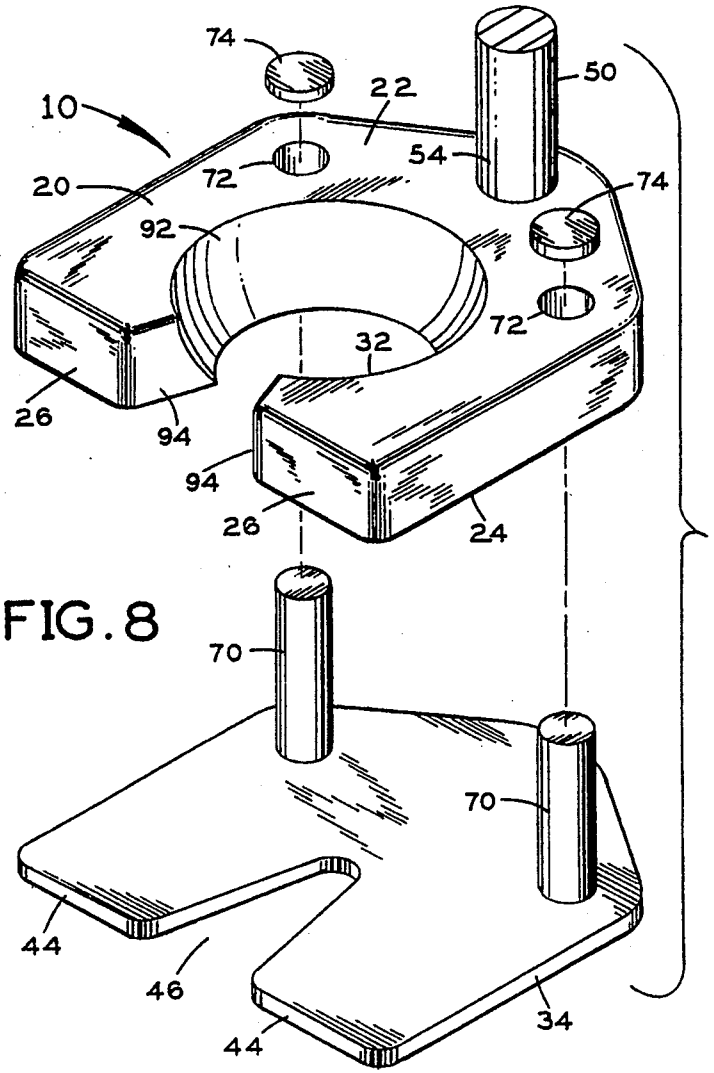
FIG. 8 is an exploded view of the second preferred embodiment, revealing the posts with their head portions removed and the platform member separated from the tee locating member and posts.

The second preferred embodiment is essentially like the first except that sliding posts 70 replace hinge element 36. See FIGS. 6–8. Posts 70 are attached to the upper surface 66 of member 34 and slide through substantially vertical ports 72 in platform member 20. Wide head portions 74 glued to the tops of posts 70 abut member 10 upper surface 22 around ports 72 and prevent posts 70 from dropping out of ports 72. Posts 70 thus permit member 34 to drop a predetermined distance below platform member 20 to engage the shank portion 48 of a tee. This sliding, spacing function is analogous to the pivoting, spacing function provided by hinge element 36.

Figure 9:
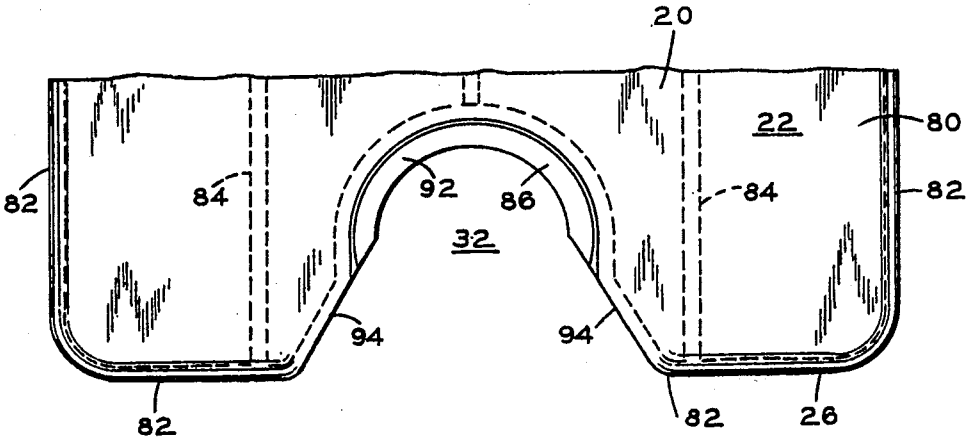
FIG. 9 is a top view of a platform member molded to have an upper wall and a side wall and rib members underneath the upper wall, the hidden wall and rib member edges being shown in broken lines.
Figure 10:
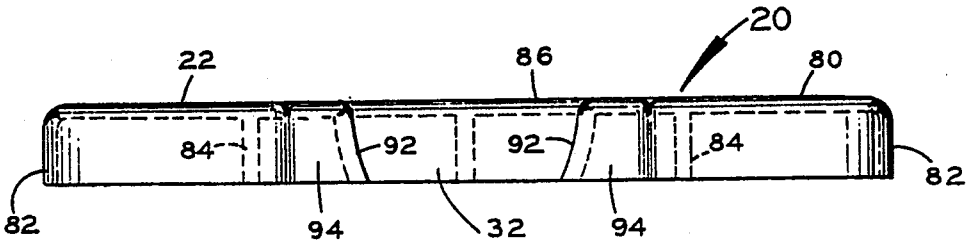
FIG. 10 is a front view of the platform member of FIG. 9, clearly revealing the beveled configuration of the ball receiving notch.

Platform member 20 is preferably an injection-molded shell having an upper wall 80, a permetral side wall 82 and reinforcing ribs 84. See FIGS. 9 and 10. Notch 32 preferably includes an arched portion 86 extending slightly more than 180 degrees, so that a ball 12 is lightly retained within arched portion 86. Arched portion 86 is preferably beveled along its upper edge 92 to better seat and retain ball 12. The ends of arched portion 86 join with outwardly diverging receiving walls 94. This combined configuration permits the ball 12 to be scooped up rather than kicked into notch 32.

Second end 52 of handle member 50 preferably includes a perpendicular segment 96 for easy gripping and maneuvering. See FIG. 1.

Method

In practicing the invention, the following method may be used. The player grips the second end 52 of handle member 50 and places platform member 20 near a golf ball 12 to be played. He maneuvers the ball 12 onto platform upper surface 22 and into ball-retaining notch 32, such as by pushing ball 12 with his foot or simply scooping up ball 12 in beveled upper edge 92. Then the player lifts handle member 50 and thus platform member 20 and ball 12, and fits the tee locating member tee-receiving notch 46 around and against the shank portion 48 of an upright golf tee 14. See FIG. 5. Ball 12 is thereby automatically positioned directly over the nest portion 62 of golf tee 14. The player lowers the handle and platform members 50 and 20, respectively, until the golf ball 12 rests on nest portion 62. Hinge element 36, or alternatively sliding posts 70, permit the tee locating member 34 notch 46 to remain in place against the shank portion 48 of tee 14 while the platform member notch 32 and ball 12 move relative to and descend upon tee nest portion 62. Then the player maneuvers platform member 20 out from under the ball 12, leaving the ball 12 mounted on the permanent golf range tee 14. It is understood that the term permanent golf range tee is intended to be illustrative in the above Detailed Description but not limiting in the claim terminology as filed with regard to golf tees generally.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. An apparatus for placing a golf ball on a golf range tee, comprising:

a ball retaining platform member having an upper surface and a lower surface, and having an edge including a ball-retaining notch for receiving and retaining a golf ball, a tee locating member hingedly joined to said platform member and to pivot to a position spaced below said lower surface, said tee locating member having an edge with a tee-receiving notch, and an elongate handle member having a first end and a second end and secured to said platform member at said first end.

2. An apparatus according to claim 1, wherein said tee locating member is hingedly joined to said platform member to pivot upward to a first position flat against said lower surface and downward to a second position to an acute angle relative to said lower surface.

3. An apparatus according to claim 1, wherein said ball retaining notch is rounded to substantially match the curvature of said ball.

4. An apparatus according to claim 1, wherein said platform portion is substantially perpendicular to said elongate handle member.

5. An apparatus according to claim 1, wherein said tee receiving notch is wider at its open end and tapers inwardly.

6. An apparatus according to claim 1, wherein said ball receiving notch comprises an upper edge which is beveled to seat said golf ball.

7. An apparatus according to claim 1, wherein said elongate handle member additionally comprises a laterally directed segment secured at said second end for enhancing manual control of said apparatus.

8. An apparatus for placing a golf ball on a golf range tee, comprising:

a ball retaining platform member having an upper surface and a lower surface, and having an edge including a ball-retaining notch for receiving and retaining a golf ball, a tee locating member joined to said platform member by sliding post means for permitting said tee locating member and said platform member to move toward each other and away from each other to a predetermined extent while remaining structurally connected, such that said tee locating member may be slidably spaced below said lower surface, said tee locating member having an edge with a tee-receiving notch, and an elongate handle member having a first end and a second end and secured to said platform member at said first end.

9. An apparatus according to claim 8, wherein said ball receiving notch comprises an upper edge which is beveled to seat said golf ball.

10. An apparatus according to claim 8, wherein said elongate handle member additionally comprises a laterally directed segment secured at said second end for enhancing manual control of said apparatus.

11. An apparatus according to claim 8, wherein said platform member comprises a substantially vertically oriented post receiving port, and wherein said tee locating member comprises a substantially vertically oriented post member positioned to register with said port and which is joined to said tee locating member, and wherein said post member comprises a post top end and stop means located at said post top end to prevent said post from dropping out of said port.

12. An apparatus for positioning a golf ball onto an upright golf range tee, comprising a ball retaining platform member having an upper surface and a lower surface, and having an edge including a notch for receiving and retaining a golf ball, a tee locating member joined to said platform member and spaced below said platform member lower surface, said tee locating member having an edge with a tee-receiving notch, and an elongate handle member having a first end and a second end and secured to said platform member at said first end, the spacing between said platform member lower surface and tee locating member being such that a golfer may grip said second end of said handle member and place said platform member near a golf ball, maneuver said ball onto said platform member upper surface and into said notch, lift said apparatus and ball with said handle member, fit said tee locating member notch around and against said shank portion of a mounted golf range tee, thereby automatically positioning said ball directly over said tee and, lower said handle and platform members until said ball rests on said tee, and then maneuvering said platform member out from under said ball, leaving said ball mounted on said tee.

* * * * *